United States Patent [19]

Pizzirani

[11] 4,370,079

[45] Jan. 25, 1983

[54] APPARATUS FOR ENCASING EXCAVATIONS

[76] Inventor: Cesare Pizzirani, Via dei Giardini, 13 - Bologna, Italy

[21] Appl. No.: 191,966

[22] Filed: Sep. 29, 1980

[30] Foreign Application Priority Data

Oct. 12, 1979 [IT] Italy ..... 3507 A/79

[51] Int. Cl.[3] ..... E02D 17/04

[52] U.S. Cl. ..... 405/272; 405/282

[58] Field of Search ..... 405/149, 272, 282, 283, 405/303; 248/225.3 A; 294/67 BB, 81 R, 93; 414/741

[56] References Cited

U.S. PATENT DOCUMENTS

| | | | |
|---|---|---|---|
| 909,808 | 1/1909 | Laughterback | 405/282 X |
| 3,777,902 | 12/1973 | Potter | 414/741 |
| 3,788,086 | 1/1974 | West, Jr. | 405/283 |
| 3,792,782 | 2/1974 | Melton | 414/741 |
| 3,905,632 | 9/1975 | Caylor et al. | 294/67 BB X |

*Primary Examiner*—David H. Corbin
*Assistant Examiner*—Nancy J. Pistel
*Attorney, Agent, or Firm*—Guido Modiano; Albert Josif

[57] ABSTRACT

An apparatus for encasing, propping or erecting false-works in soil excavations comprises a crane and extendible struts intended for installation in the excavation and for actuation by the crane boom. Each strut comprises a main inverted-T shaped tubular body and a pair of elements which are mounted, for sliding movement to and fro each other, on the bar of said "T" and are caused to slide by means of a nut-and-screw coupling and terminated externally with respective plate-like frames for propping the excavation walls.

6 Claims, 4 Drawing Figures

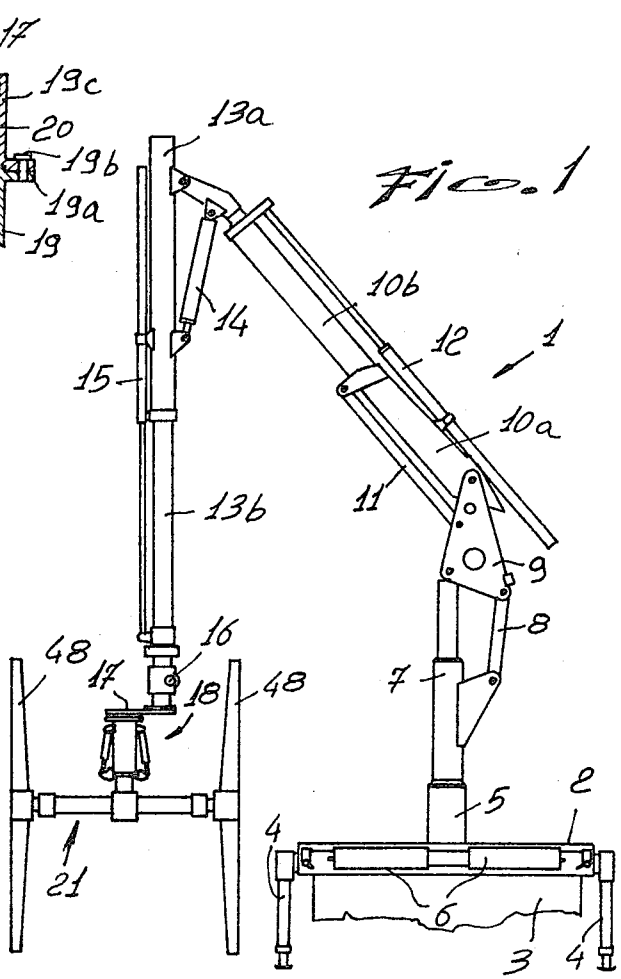
Fig. 1
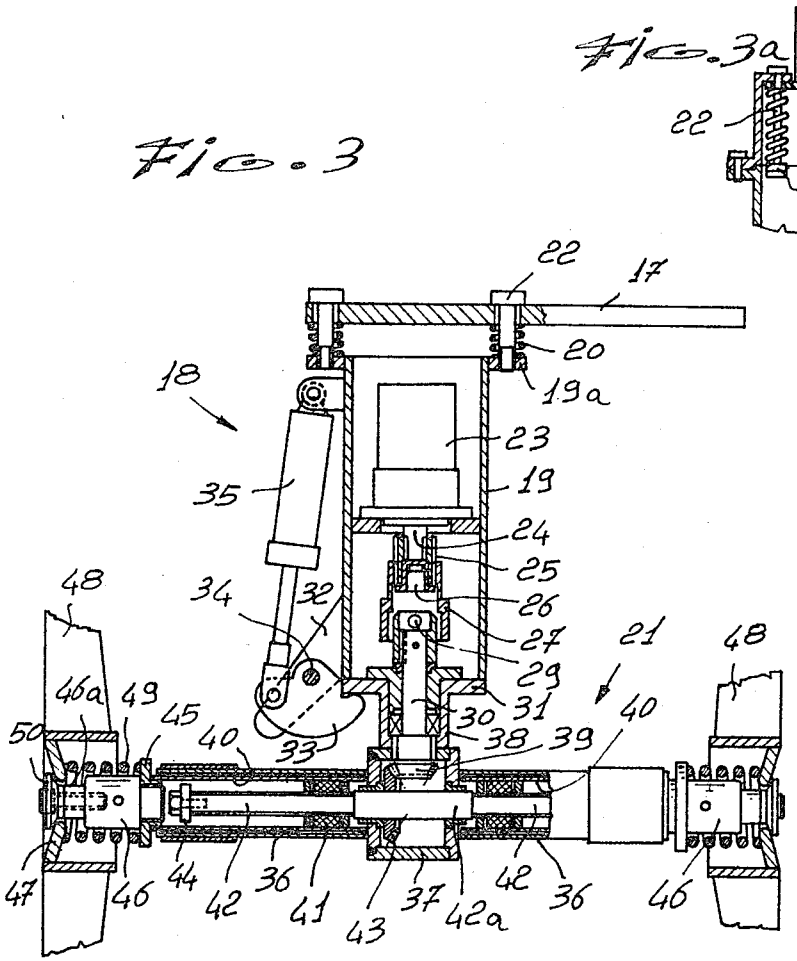
Fig. 3
Fig. 3a

APPARATUS FOR ENCASING EXCAVATIONS

BACKGROUND OF THE INVENTION

This invention relates to an apparatus for encasing, propping or erecting falseworks in excavations and the like.

To facilitate the work of erecting falseworks in excavations, an apparatus is currently available which includes a crane movable on the ground surface (either truck-mounted or automotive) and extendible struts or props which are put in position on or removed from the site by means of the crane boom and which, also by means of the crane boom, are actuated to take their extended operative positions retracted inoperative positions.

SUMMARY OF THE INVENTION

This invention sets out to provide an apparatus of the same general type as above, which is considerably simplified, such that its manufacture and use become economically advantageous and its range of application much wider, even when employed in small width excavations.

According to the invention, there is provided an apparatus for encasing excavations, comprising a movable crane equipped with a boom, and extendible struts or props adapted to be put in position on the excavation site and to be actuated by said crane boom, characterized in that each strut comprises a tubular main body in the shape of an inverted "T" and defining a gripping collar at the leg of said "T", a pair of elements mounted for sliding to and fro each other along the bar of said "T", the sliding movement of said elements being controlled through a nut-and-screw drive, said elements terminating at the outer ends thereof in plate-like frames for propping the excavation walls, and a driveshaft driving said nut-and-screw drive through a bevel gear pair, said driveshaft being journaled at said leg of said "T" and projecting above it with a clutch member, said crane boom being terminated at the bottom end thereof with an actuator assembly adapted to overlie said leg and being provided with clamping jaws for said collar as well as a reversible motor carrying a mating clutch member for engagement with said clutch member and entraining said driveshaft.

BRIEF DESCRIPTION OF THE DRAWINGS

Further details will be more clearly understood from the description of a preferred embodiment of this apparatus, as illustrated by way of example in the accompanying drawings, where:

FIG. 1 is a general elevation view of the apparatus shown in the operative position;

FIG. 3 is a longitudinal vertical section of one of the struts, when engaged by the actuator assembly; and FIG. 3*a* shows another embodiment, different from the one illustrated in FIGS. 2 and 3, of the mount for said actuator assembly.

DESCRIPTION OF THE PREFERRED EMBODIMENTS

Figure 2:
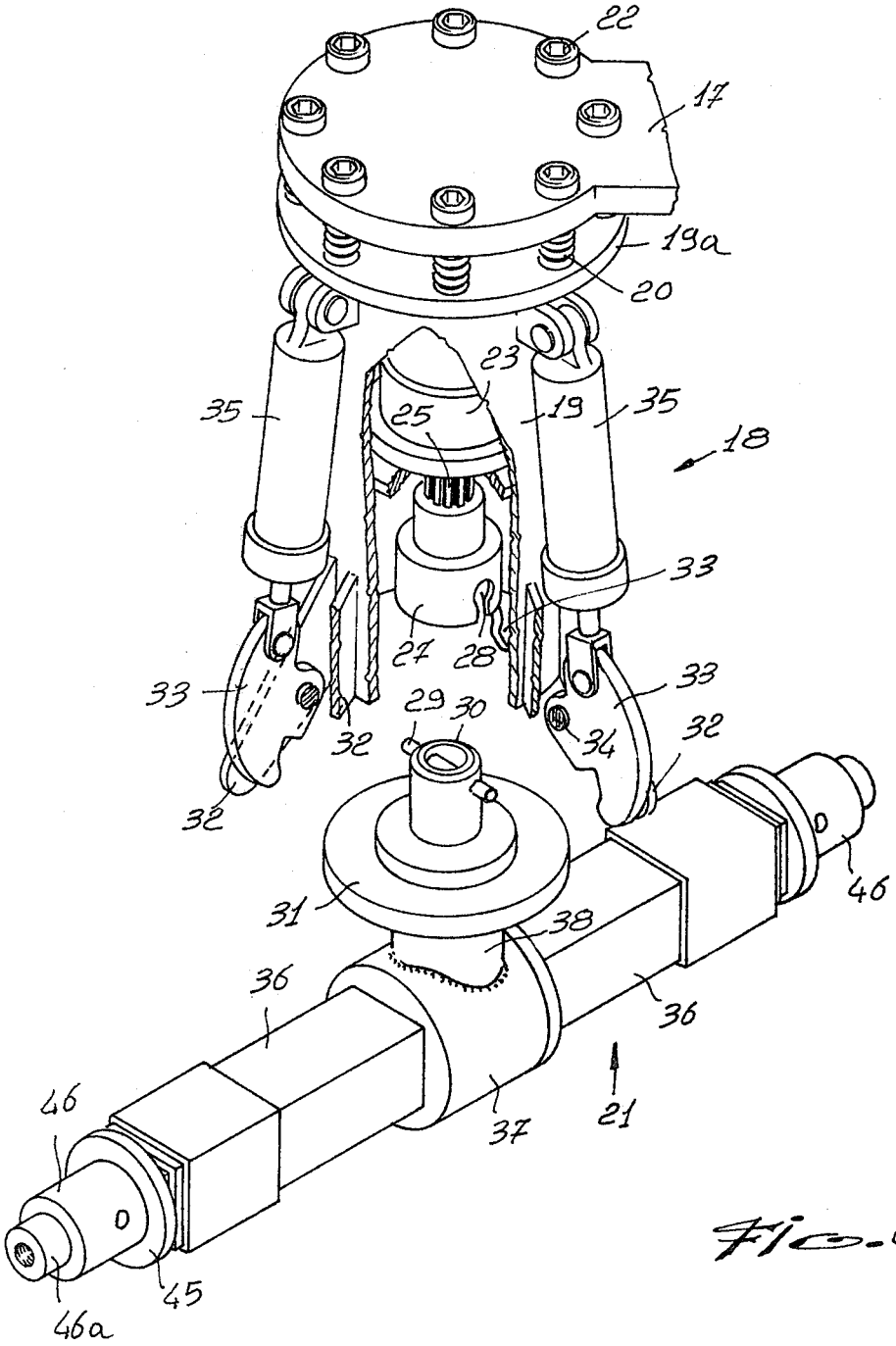
FIG. 2 is a partly cut-away perspective view of the actuator assembly, shown just before engaging one of the struts.

With reference to the drawing figures, the numeral 1 generally indicates a crane, carried on a platform 2; the platform 2 is mounted on a carrier, and is a component part of it. The carrier is either of the wheeled or cater pullar track type, that is a carrier of the type of a truck or manenvering vehicle, said carrier being schematically indicated at 3. Thus, the crane can be moved over the ground, along either side of the excavation, or even astride the excavation if the carrier gauge allows. The platform 2 is provided with extendible legs 4 which have a stabilizing function and are adapted for engaging the ground while the crane is being operated. The crane 1 comprises an upright or column 5 rotatably mounted on the platform 2 and controllable to take a desired angular position by means of a pair of jacks 6. The column 5 comprises a coaxial jack 7 which is part of an articulated quadrilateral, having an extendible side provided by the jack, further including a rod 8 and plate 9 materializing other two sides of the quadrilateral. Articulated to the plate 9, is the segment 10*a* of the crane boom, the angular position of said segment with respect to said plate being adjustable by means of the jack 11. The amount of extension of the other segment 10*b* of the crane boom can be varied by means of the jack 12. Articulated to the segment 10*b*, is the segment 13*a* of the crane jib, the inclination angle of the jib being adjustable through the jack 14; the jack 15 is operative to change the extent of extension of the other segment 13*b* of the crane jib. Arranged at the end of the segment 13*b*, is an assembly 16 operative to adjust the angular position about the axis of the jib 13*a–b* of a support 17, wherefrom the actuator assembly 18 of the crane is suspended.

The actuator assembly 18 (FIG. 3) comprises a tubular body 19, which is suspended at the top from the support 17 at an offset position and with the interposition of a series of compression springs 20 uniformly angularly distributed. The eccentricity of the actuator assembly 18 with respect to the jib 13*a–b* makes it possible to actuate the struts 21 to be actuated, which are arranged in the excavation or trench at different heights on the same vertical plane; the limited extent of oscillation permitted by the springs 20, through a greater or smaller compression thereof, to the body 19 with respect to the support 17, enables, as will be explained hereinafter, a correct engagement of the actuator assembly with a strut 21. In accordance with the embodiment shown in FIGS. 2 and 3, the body 19 defines at the top a flange 19*a*, whereto bolts 22 are attached which are passed with some clearance through the support 17; in the space thus left between the support and flange, compression springs 20 are interposed for which the bolts 22 function as guides. As shown in FIG. 3*a*, the flange 19*a* is engaged by screws 19*b* which secure to the body 19 a tubular bell-like element 19*c*, wherein a lower shoulder 17*a* of the support 17 is inserted; this shoulder tends to remain in contact with the upper edge of the bell 19*c* by virtue of the springs 20 being interposed between that shoulder and tabs 19*d* on the body 19, the springs being guided by bolt ties 22 extending between the tabs 19*d* and the upper edge of the bell 19*c* and passed with some clearance through the shoulder 17*a*.

Inside the body 19, a reversible motor 23 is provided the shaft 24 whereof is oriented downwards and has attached thereto an externally splined tubular element 25. The tube 25 is in rigid rotatory relationship with the shaft 24 by means of keys cooperating with the splines provided therein (not shown), whilst the axial limit stop is obtained by means of a cap 26, which is clamped against the end of said shaft 24 and covers at the bottom the splines of the tube 25. A sleeve 27 is axially slidable but not rotatable on the tube 25; in fact the top portion of the sleeve 27 is splined internally, and the downward stroke limit for this portion, and accordingly for the sleeve 27 as a whole, is established by the edge of the cap 26. The widened bottom portion of the sleeve 27 has a pair of cutouts 28 (FIG. 2), which are located at diametrically opposite positions, extend parallel to the axis of said bottom portion and are open downwardly. Such cutouts are operative to accommodate, as will be explained hereinafter, lugs 29 which are located at the top of the shaft 30 in diametrically opposite positions. The shaft 30 projects upwardly from each strut 21 and from a collar 31. The collar 31 of the strut is adapted for abutment against the lower edge of the body 19 of the actuator assembly when the body 19 is lowered towards the strut 21, the top of the shaft 30 penetrating into the downwardly open hollow of said body: the lugs 29 are not aligned with the cutouts 28, then during the downward movement of the unit 18 the sleeve 27 will be raised relative to the body 19 by sliding along the tube 25, to then sink again by gravity as soon as said cutouts 28, as the motor 23 is operated to impart rotation to the sleeve 27, are located in alignment with the lugs 29 and ready for engagement therewith. In at least three positions uniformly located circumferentially at equal angles apart from the lower portion of the body 19, there project outwardly and downwardly vane pairs 32 which diverge downwards: as the crane brings the actuator assembly 18 to overlie the collar 31 of one strut, hence causing it to move down toward that collar, the vanes 32 create a sort of lead-in to penetration and centering of the collar 31 onto the lower edge of the body 19. Against this same edge, the collar is then clamped by jaws 33; each jaw is pivoted at 34 on its respective vane pair 32, and is accordingly controlled by a respective jack 35 acting between that jaw and the upper portion of the body 19.

Each strut 21 comprises a main body in the shape of an inverted "T" and of tubular configuration: the bar of the "T" is formed by two prismatic tubings 36 which converge to a central box 37, wherefrom there extends upwardly a short tube 38 which constitutes the leg of the "T" and terminates at the top with the collar 31. The shaft 30 is journaled at 38 and terminates with a bevel gear 39 located inside the box 37. Inside each tubing 36, there is slidable an element 40, also prismatic and tubular, which, at the proximity of the box 37, is provided with a nut 41 rigid therewith. To cause the two elements 40 to slide to and fro each other (to extend from the tubings 36 as the excavation falsework is being erected, and retract during the dismantling thereof), the two nuts 41 are oppositely threaded and coupled with mating screw portions 42, formed on an axle the middle portion **42*a* whereof is mounted for rotation in the box 37. The axle 42, 42*a* carries within said box a bevel gear 43 keyed thereto and in mesh engagement with the gear 39 on the driveshaft 30. The free ends of the portions 42 are provided with a shoulder 44, adapted for limiting the outward stroke of the elements 40 from the tubings 36. Externally to the respective tubing 36, each element 40 is closed by a ring 45 and has a head 46, which is threaded to the ring and defines outwardly an inside threaded shank 46*a*. On this shank, there is mounted with some clearance a ring 47 which is a part of a bowl-like member located centrally to a plate-like frame 48, which frame takes a transversal lay to the strut and is intended for a force fit and holding against the walls of the excavation (to the outside of the frame there being attached planks not shown in the drawings). The ring 47 has an outwardly diverging and inwardly converging shape; between this ring and the ring 45, there is interposed a powerful compression spring 49 which urges the ring 47 against the shoulder 50, which is also outwardly divergent and is attached to the shank 46*a* by means of screws. Thus, as the motor 23 turns the shaft 30 in the desired direction and the elements 40 of one strut are extended, the frames 48 are brought to bear on the walls of the excavation and are also enabled to take an inclined lay with respect to the strut; moreover, the springs 49 are always overloaded to make them additionally expand and urge the frames 48 against the walls of the excavation, even if some soil may fall, for any reason whatsoever, off the excavation walls. It should be noted that, by removing the shoulder 50, it becomes possible to install on the head 46 one end of an extension member of the element 40, the other end of said extension member being provided with a like head 46 with like shank 46*a* for the application of an additional extension member or of the frame 48: the heads 46** are formed with transversal through holes for the insertion for connecting thereto locking pin members therein of the respective end of any additional extension member.

I claim:

1. An apparatus for encasing excavations, comprising a movable crane equipped with a boom, and extendible struts adapted for rigging on the job site and for handling by said crane boom, characterized in that each strut comprises a tubular main body in the shape of an inverted "T" and defining a gripping collar at the leg of said "T", a pair of elements mounted for sliding to and fro each other along the bar of said "T", the sliding movement of said elements being controlled through a nut-and-screw drive, said elements terminating at the outer ends thereof in plate-like frames for propping the excavation walls, and a driveshaft driving said nut-and-screw drive through a bevel gear pair, said driveshaft being journaled at said leg of said "T" and projecting above it with a clutch member, said crane boom being terminated at the bottom end thereof with an actuator assembly intended to overlie said leg and being provided with clamping jaws for said collar as well as a reversible motor carrying a mating clutch member for engagement with said clutch member and entraining said driveshaft.

2. An apparatus according to claim 1, characterized in that said actuator assembly defines at the bottom an edge for resting on said collar and downwardly diverging projections or vanes to form a lead-in for the penetration and centering of said collar on said edge, said jaws being uniformly angularly distributed externally to said assembly and intended for clamping said collar against said edge.

3. An apparatus according to claim 1, characterized in that said actuator assembly is suspended eccentrically from the bottom end of said crane boom with the interposition of elastic members.

4. An apparatus according to claim 1, characterized in that the downwards facing shaft of said motor has engaged transversally therewith and axially slidable therealong a sleeve, said sleeve having, below said shaft and above said edge of the actuator assembly, a portion provided with front cutouts adapted for engagement with corresponding lugs of said shaft of one strut, said lugs and cutouts constituting said clutch and mating clutch members.

5. An apparatus according to claim 1, characterized in that each said plate-like frame has a central, outwardly diverging ring, said ring being mounted, with radial and axial clearance, on a terminating shank of a respective one of said sliding elements and urged by a spring toward a similarly diverging shoulder at the end of said shank, such that said spring can be overloaded during the positioning of said respective strut in place, and correspondingly said plate-like frame is also enabled to take an inclination over the respective strut.

6. An apparatus according to claim 5, characterized in that each said shoulder is removable from said head, provided with a shank, of the respective one of said sliding elements, to said head there being insertable and attachable one end of an extension element of said sliding element, the other end of said extension element being also provided with a similar head with shank.

* * * * *